US011643301B2

(12) United States Patent
Chen et al.

(10) Patent No.: US 11,643,301 B2
(45) Date of Patent: May 9, 2023

(54) SYSTEM AND METHOD FOR MONITORING SHEAVE BEARING CONDITION

(71) Applicant: OTIS ELEVATOR COMPANY, Farmington, CT (US)

(72) Inventors: Yan Chen, East Hartford, MI (US); David R. Polak, Glastonbury, CT (US); Paul R. Braunwart, Hebron, CT (US); Zaffir A. Chaudhry, S. Glastonbury, CT (US); Charles C. Coffin, Vernon, CT (US)

(73) Assignee: OTIS ELEVATOR COMPANY, Farmington, CT (US)

( * ) Notice: Subject to any disclaimer, the term of this patent is extended or adjusted under 35 U.S.C. 154(b) by 799 days.

(21) Appl. No.: 16/665,127

(22) Filed: Oct. 28, 2019

(65) Prior Publication Data

US 2021/0122608 A1 Apr. 29, 2021

(51) Int. Cl.

| | |
|---|---|
| ***B66B 5/00*** | (2006.01) |
| ***B66B 5/02*** | (2006.01) |
| ***B66B 15/04*** | (2006.01) |

(52) U.S. Cl.

CPC ..... *B66B 5/0018* (2013.01); *B66B 15/04* (2013.01)

(58) Field of Classification Search

CPC ..... B66B 5/00; B66B 5/0006; B66B 5/0018–0037; B66B 5/0087; B66B 7/12–1215; B66B 11/005; B66B 11/04

See application file for complete search history.

(56) References Cited

U.S. PATENT DOCUMENTS

| | | | | |
|---|---|---|---|---|
| 7,606,673 | B2 * | 10/2009 | Judd | G01H 13/00 702/56 |
| 9,731,939 | B2 * | 8/2017 | Sun | B66B 7/1223 |
| 2018/0231413 | A1 * | 8/2018 | Franchitti | G01N 29/42 |
| 2020/0225117 | A1 * | 7/2020 | Hayzen | F16C 19/527 |
| 2021/0229953 | A1 * | 7/2021 | Saarelainen | G01M 13/04 |
| 2022/0119222 | A1 * | 4/2022 | Talonen | B66B 25/006 |

* cited by examiner

*Primary Examiner* — Christopher Uhlir

(74) *Attorney, Agent, or Firm* — Carlson, Gaskey & Olds, P.C.

(57) ABSTRACT

This disclosure relates to a system and method for monitoring a sheave bearing condition, and in particular relates to passenger conveyer systems, such as elevator systems, employing the system and method. An example passenger conveyer system includes a suspension member, and a sheave configured to rotate on a bearing. The suspension member is wrapped around at least a portion of the sheave. Further, the system includes a sensor mounted adjacent an end of the suspension member, and a controller configured to determine a condition of the bearing based on an output of the sensor.

20 Claims, 1 Drawing Sheet

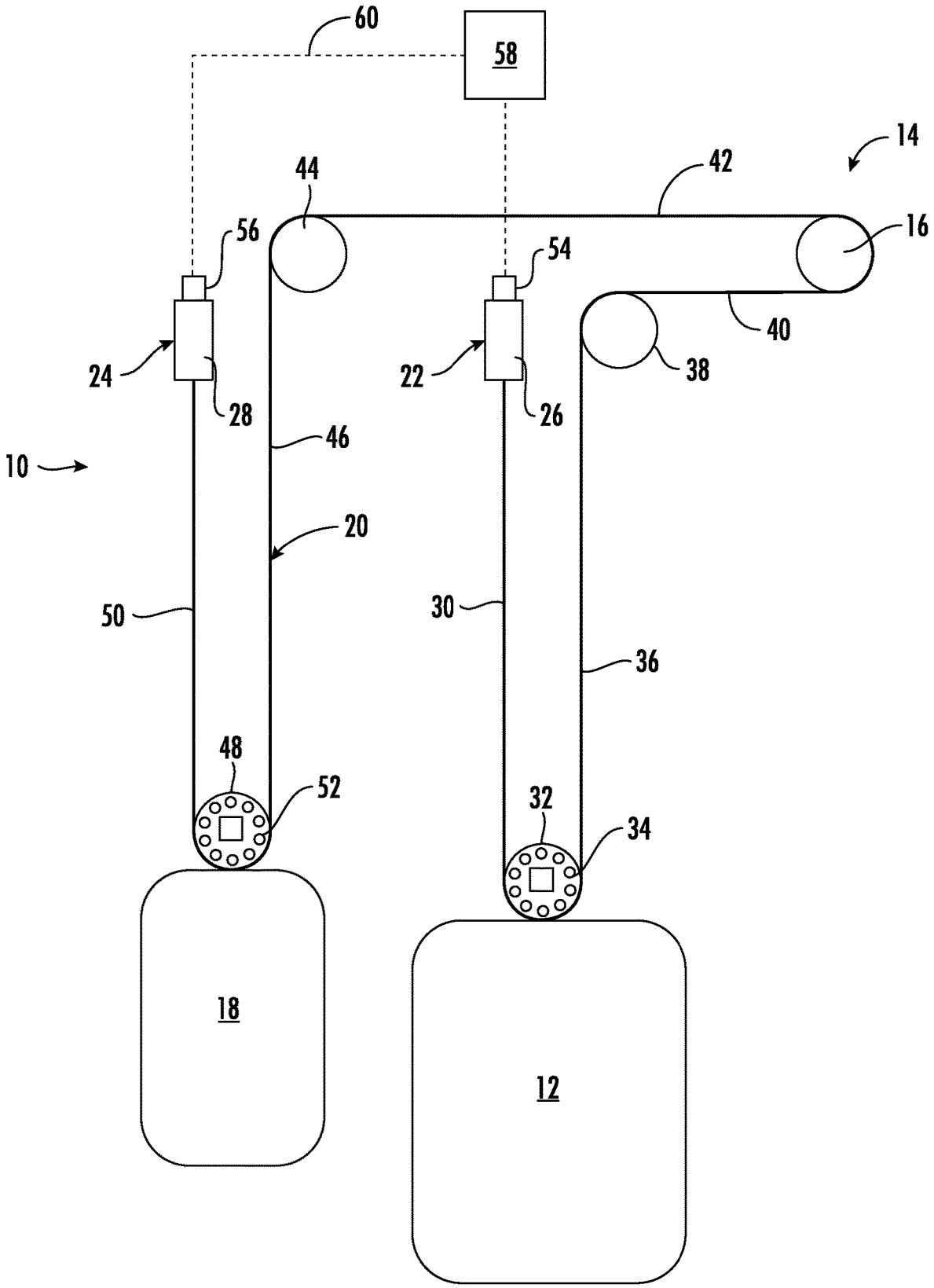
60
58
14
44
42
56
16
54
40
24
22
38
28
26
46
10
20
50
30
36
48
52
32
34
18
12

SYSTEM AND METHOD FOR MONITORING SHEAVE BEARING CONDITION

TECHNICAL FIELD

This disclosure relates to a system and method for monitoring a sheave bearing condition, and in particular relates to passenger conveyer systems, such as elevator systems, employing the system and method.

BACKGROUND

Passenger conveyer systems such as elevator systems generally include a motor, drive shaft, and brake system. In the context of an elevator system, the motor, drive shaft, and brake system control movement of an elevator car within a hoistway. Specifically, an elevator car and a counterweight are typically suspended from one or more suspension members, such as belts or ropes, wrapped around the drive shaft. The suspension members are also typically wrapped around one or more sheaves, which in turn are configured to rotate on bearings known as sheave bearings.

SUMMARY

A passenger conveyer system according to an exemplary aspect of the present disclosure includes, among other things, a suspension member and a sheave configured to rotate on a bearing. The suspension member is wrapped around at least a portion of the sheave. Further, the system includes a sensor mounted adjacent an end of the suspension member, and a controller configured to determine a condition of the bearing based on an output of the sensor.

In a further non-limiting embodiment of the foregoing passenger conveyer system, the system includes an elevator car and a counterweight. Further, the sheave is mounted adjacent one of the elevator car and the counterweight.

In a further non-limiting embodiment of any of the foregoing passenger conveyer systems, the sheave is a first sheave configured to rotate on a first bearing and mounted adjacent the elevator car, the passenger conveyer system includes a second sheave configured to rotate on a second bearing, the second sheave is mounted adjacent the counterweight, and the suspension member is wrapped around at least a portion of the first and second sheaves.

In a further non-limiting embodiment of any of the foregoing passenger conveyer systems, the sensor is a first sensor mounted adjacent a first end of the suspension member, and the passenger conveyer system includes a second sensor mounted adjacent a second end of the suspension member opposite the first end.

In a further non-limiting embodiment of any of the foregoing passenger conveyer systems, the first end of the suspension member is an end of a segment of the suspension member extending directly to the first sheave, and the second end of the suspension member is an end of a segment of the suspension member extending directly to the second sheave.

In a further non-limiting embodiment of any of the foregoing passenger conveyer systems, the controller is configured to determine a condition of the first bearing based on an output of the first sensor, and the controller is configured to determine a condition of the second bearing based on an output of the second sensor.

In a further non-limiting embodiment of any of the foregoing passenger conveyer systems, the sensor is an accelerometer.

In a further non-limiting embodiment of any of the foregoing passenger conveyer systems, the controller is configured to identify a potential impaired condition of the bearing when the output of the sensor exceeds a threshold.

In a further non-limiting embodiment of any of the foregoing passenger conveyer systems, the controller applies a filter to the output of the sensor to reject portions of the output unlikely to be indicative of the potential impaired condition.

In a further non-limiting embodiment of any of the foregoing passenger conveyer systems, the threshold is a threshold in at least one of a time domain and a frequency domain, and the controller is configured to identify the potential impaired condition based on an amplitude of an output of the sensor exceeding the threshold in a time domain or a frequency domain.

In a further non-limiting embodiment of any of the foregoing passenger conveyer systems, the controller determines an RMS acceleration based on the output and compares the RMS acceleration to the threshold.

In a further non-limiting embodiment of any of the foregoing passenger conveyer systems, the controller is configured to transform an output of the sensor from the time domain to the frequency domain.

In a further non-limiting embodiment of any of the foregoing passenger conveyer systems, the controller is configured to identify a plurality of different potential impaired conditions of the bearing when the output of the sensor exceeds a threshold corresponding to a respective one of the plurality of different potential impaired conditions.

In a further non-limiting embodiment of any of the foregoing passenger conveyer systems, the plurality of different potential impaired conditions include potential impairments of a ball of the bearing, a cage of the bearing, an outer race of the bearing, and an inner race of the bearing.

In a further non-limiting embodiment of any of the foregoing passenger conveyer systems, the system includes a drive shaft, and the sensor is not mounted adjacent a segment of the suspension member leading directly to the drive shaft.

In a further non-limiting embodiment of any of the foregoing passenger conveyer systems, the controller is configured to cause a prompt to be issued in response to the potential impaired condition being identified.

A method according to an exemplary aspect of the present disclosure includes, among other things, identifying a potential impaired condition of a bearing of a sheave based on an output of a sensor mounted adjacent an end of a suspension member. The sheave is mounted adjacent one of an elevator car and a counterweight.

In a further non-limiting embodiment of the foregoing method, the method includes identifying a potential impaired condition of a first bearing of a first sheave mounted adjacent the elevator car based on an output of a first sensor mounted adjacent a first end of the suspension member adjacent a segment of the suspension member leading directly from the first end to the first sheave. The method further includes identifying a potential impaired condition of a second bearing of a second sheave mounted adjacent the counterweight based on an output of a second sensor mounted adjacent a second end of the suspension member adjacent a segment of the suspension member leading directly from the second end to the second sheave.

In a further non-limiting embodiment of any of the foregoing methods, the identifying step includes identifying at least one of an impairment of a ball of the bearing, a cage of the bearing, an outer race of the bearing, and an inner race of the bearing.

In a further non-limiting embodiment of any of the foregoing methods, the identifying step includes determining that the output of the sensor exceeded a threshold in at least one of a time domain and a frequency domain.

The embodiments, examples and alternatives of the preceding paragraphs, the claims, or the following description and drawings, including any of their various aspects or respective individual features, may be taken independently or in any combination. Features described in connection with one embodiment are applicable to all embodiments, unless such features are incompatible.

BRIEF DESCRIPTION OF THE DRAWINGS

FIG. 1 schematically illustrates an example passenger conveyer system.

DETAILED DESCRIPTION

This disclosure relates to a system and method for monitoring a sheave bearing condition, and in particular relates to passenger conveyer systems, such as elevator systems, employing the system and method. An example passenger conveyer system includes a suspension member, and a sheave configured to rotate on a bearing. The suspension member is wrapped around at least a portion of the sheave. Further, the system includes a sensor mounted adjacent an end of the suspension member, and a controller configured to determine a condition of the bearing based on an output of the sensor. This disclosure enables real-time monitoring, possibly at a remote location (i.e., not on site), of the condition of the sheave bearing, which permits one to perform condition-based maintenance of the sheave bearing as opposed to solely performing periodic inspections of the sheave bearing. Further, this disclosure is relatively easily incorporated into an existing elevator system, meaning that this disclosure may be used to retrofit existing elevator systems with a real-time sheave bearing monitoring feature. These and other benefits will be appreciated from the following written description.

FIG. 1 schematically illustrates an example passenger conveyer system 10. In FIG. 1, the passenger conveyer system 10 is an elevator system, however this disclosure may be extended to other passenger conveyer systems such as escalators.

The passenger conveyer system 10 includes an elevator car 12 configured to travel in a hoistway. Travel of the elevator car 12 is governed, in this example, by a drive system 14 including an electric motor, a drive shaft 16 mechanically connected to the electric motor, and one or more brakes. The drive shaft 16 may be mounted in the hoistway or outside the hoistway in a machine room, as examples.

The elevator car 12 and a counterweight 18 are suspended from a suspension member 20, such as a belts or rope, wrapped at least partially around the drive shaft 16. Thus, when the drive shaft 16 rotates, the elevator car 12 moves vertically up or down within the hoistway depending upon the direction of rotation of the drive shaft 16. While only one suspension member 20 is shown in FIG. 1, it should be understood that the elevator car 12 and counterweight 18 may be suspended from multiple suspension members.

The suspension member 20 extends between a first end 22 and a second end 24. In this example, the first end 22 and second end 24 of the suspension member 20 are attached to respective first and second terminations 26, 28, which may include wedge sockets, swaged terminals, ferrules and thimbles, or other known types of terminations for elevator suspension members. Reference herein to an end of the suspension member 20 includes the ends 22, 24 and the terminations 26, 28. The ends 22, 24 and terminations 26, 28 may be relatively close to one another and may be arranged adjacent one another in a machine room, for example.

The suspension member 20 in this example includes a first segment 30 extending directly from the first end 22 to a first sheave 32, which is mounted to the elevator car 12 and is configured to rotate on (i.e., spin on) a first bearing 34. The term directly is used mean that there are no intervening sheaves, for example, between the first end 22 and the first sheave 32 along the segment 30. The first sheave 32 is configured to travel with the elevator car 12 as it moves within a hoistway during operation of the passenger conveyer system 10.

In this example, the first bearing 34 includes an inner race, an outer race, a cage, and a plurality of rolling elements such as balls. The suspension member 20 is wrapped around at least a portion of the first sheave 32. While only one first sheave 32 is shown, there may be multiple first sheaves mounted to the elevator car 12.

The suspension member 20 includes a second segment 36 extending directly from the first sheave 32 to a second sheave 38, a third segment 40 extending directly from the second sheave 38 to the drive shaft 16, and a fourth segment 42 extending directly from the drive shaft 16 to a third sheave 44. A fifth segment 46 of the suspension member 20 extends directly from the third sheave 44 to a fourth sheave 48 mounted to the counterweight 18. A sixth segment 50 of the suspension member 20 extends directly from the fourth sheave 48 to the second end 24. The fourth sheave 48 is configured to travel with the counterweight 18 as it moves during operation of the passenger conveyer system 10. As with the first sheave 32, the suspension member 20 is wrapped at least partially around each of the sheaves 38, 44, 48 and the drive shaft 16.

The term segment as used relative to the segments 30, 36, 40, 42, 46, and 50 is used to refer to segments of the overall length of the suspension member 20 between adjacent ends and/or sheaves. A distance between adjacent ends and/or sheaves may change during operation of the passenger conveyer system 10. While the suspension member 20 is arranged such that it exhibits six segments in this example, it should be understood that this disclosure extends to other arrangements including additional or fewer sheaves and additional or fewer segments. Further, while the drive shaft 16 is shown in a particular location, the drive shaft 16 could be located elsewhere along the suspension member 20. The terms "first," "second," "third," etc., as used herein relative to the sheaves and segments is arbitrary and used for purposes of explanation only.

The sheaves discussed above may each be configured to rotate on a bearing configured similar to the bearing 34. For instance, the sheave 48 is configured to rotate on a bearing 52 including an inner race, an outer race, a cage, and a plurality of rolling elements such as balls. The bearings 34, 52 may be referred to as sheave bearings, or bearings of the sheave. The bearings 34, 52 may each include one or more bearings, such as a set of two bearings.

This disclosure is configured to monitor a condition, namely a health condition, of the bearings in the passenger conveyer system 10. In particular, this disclosure is configured to monitor the condition of the bearings 34, 52 to identify potential impaired conditions of the bearings 34, 52. The term potential impaired condition is used herein to refer to conditions where a condition of a bearing has possibly reduced in quality relative to a normal operating condition and which may result in reduced ride quality. The term potential impaired condition is inclusive of conditions where the bearing has actually been damaged or the operation of the bearing is actually impaired from wear or a defect, but also includes conditions where the bearing is not damaged but may possibly be impaired. The potential impaired condition of the bearing could be caused by another component, such as the adjacent sheave or an interaction between the sheave and the suspension member. In response to a potential impaired condition, an inspection of the bearing may be performed and it may be determined that there is no issue with the bearing, that the bearing or another component requires service, or that the bearing or another component must be replaced.

In FIG. 1, a first sensor 54 is mounted adjacent the first end 22, and in particular is directly attached to the first termination 26. A second sensor 56 is mounted adjacent the second end 24, and in particular is directly attached to the second termination 28. The first and second sensors 54, 56 are accelerometers in this example and are configured to generate outputs indicative of a condition of the bearings 34, 52. In particular, the first and second sensors 54, 56 are configured to generate outputs indicative of a vibration in a respective segment 30, 50 of the suspension member 20.

While two sensors 54, 56 are shown in FIG. 1, this disclosure extends to passenger conveyer systems including one or more sensors. For instance, the passenger conveyer system 10 may include one or both of the sensors 54, 56.

The first and second sensors 54, 56 are electronically connected to a controller 58. The controller 58 is shown schematically in FIG. 1. The controller 58 includes electronics, software, or both, to perform the functions described herein. In one non-limiting embodiment, the controller 58 is an elevator drive controller. Although it is shown as a single device, the controller 58 may include multiple controllers in the form of multiple hardware devices, or multiple software controllers within one or more hardware devices. The controller area network 60 allows the controller 58 to communicate with various components, namely the first and second sensors 54, 56, of the passenger conveyer system 10 by wired and/or wireless electronic connections.

The controller 58 is configured to determine a condition of the bearings 34, 52 based on respective outputs of the first and second sensors 54, 56. The controller 58 could alternatively or additionally be configured to detect noise from a sheave-suspension member interaction based on the outputs of the sensor 54, 56. By arranging the first and second sensors 54, 56 adjacent respective first and second ends 22, 24, noise from other components of the passenger conveyer system 10, such as the drive shaft 16, is reduced. The first and second sensors 54, 56 are not mounted adjacent segments of the suspension member 20 leading directly to the drive shaft 16, such as segments 40 or 42. In this way, the output of the first and second sensors 54, 56 is representative of the vibration in the respective segment 30, 50, which in turn may be interpreted by the controller 58 as a condition of the respective bearing 34, 52.

The first and second sensors 54, 56 are accelerometers and are configured to measure vibration. In this example, the first and second sensors 54, 56 are configured to generate an output signal having an amplitude indicative of the acceleration of the respective segments 30, 50. The controller 58 is configured to identify a potential impaired condition of a respective one of the first and second bearings 34, 52 when the output of the respective first and second sensor 54, 56 exceeds a threshold.

The threshold may be a predetermined threshold known to correspond to a potential impaired condition. The controller 58 may consider a plurality of different thresholds in parallel. The different thresholds may correspond to different potential impaired conditions of the bearings 34, 52. In particular, there may be different thresholds corresponding to a potential impaired condition of the inner race, outer race, cage, and rolling elements.

If the output meets or exceeds one of the thresholds, the controller 58 identifies a potential impaired condition. In response to that determination, the controller 58 may send a signal or issue a prompt to maintenance personnel. If known, the prompt may also indicate that the potential impaired condition applies to a particular component (i.e., the inner race, outer race, cage, or rolling elements) of a particular bearing (i.e., bearing 34 or 52). The controller 58 may also shut down operation of the passenger conveyer system 10 until an inspection is performed in some examples.

In order to determine whether a threshold has been met or exceeded, the controller 58 may analyze the outputs of the first and second sensors 54, 56 using a conventional analysis and/or an envelope analysis. Performing redundant analyses may give additional confidence to the determination that there is a potential impaired condition of a bearing. That said, this disclosure is not limited to redundant analyses, and the outputs of the first and second sensors 54, 56 may be analyzed using one analytical technique.

In a conventional analysis, the controller 58 compares the output of the first and second sensors 54, 56 in one or both of a time domain and a frequency domain to one or more of the predetermined thresholds. In the time domain, the controller 58 may compare a root mean square (RMS) acceleration, which is the average of the time-varying acceleration data over a particular time window. If the RMS acceleration, as reported by a particular one of the first and second sensors 54, 56, exceeds a threshold, then the controller 58 identifies a potential impaired condition of the respective bearing 34, 52.

The controller 58 may also analyze the outputs of the first and second sensors 54, 56 by transforming them to the frequency domain and comparing the outputs to thresholds known to correspond to potential impaired conditions at certain frequencies. Again, if one or more of the thresholds is exceeded, a potential impaired condition is identified. In one example, analyzing the outputs of the first and second sensors 54, 56 in the frequency domain enables the controller 58 to identify potential impaired conditions associated with the individual components of the bearings 34, 52. For instance, unduly large amplitudes at a certain frequency may be associated with a cage defect, while an unduly large amplitude at another frequency may be associated with a rolling element defect.

In an envelope analysis, the controller 58 may process the output signals from the first and second sensors 54, 56 and use the processed signals to determine whether there is a potential impaired condition. In one example, the controller 58 applies a filter, such as a band-pass filter, to the output of the first and second sensors 54, 56 so that the frequencies known to correspond and show sensitivity to bearing degradation are allowed to pass. In a further example, the filer rejects portions of the outputs unlikely to be indicative of the potential impaired condition of the bearings 34, 52. For instance, if a frequency of the drive shaft 16 during operation is known, the controller 58 may filter out that frequency.

The controller 58 may consider whether the output of the processed and/or filtered signal exceeds one or more thresholds in the time domain and/or the frequency domain. The controller 58, in particular, may consider whether an RMS acceleration of the filtered signal exceeds a threshold in the time domain and/or consider whether the amplitude of the filtered signal exceeds one or more thresholds at certain frequencies in the frequency domain.

It should be understood that terms such as "generally," "substantially," and "about" are not intended to be boundaryless terms, and should be interpreted consistent with the way one skilled in the art would interpret those terms.

Although the different examples have the specific components shown in the illustrations, embodiments of this disclosure are not limited to those particular combinations. It is possible to use some of the components or features from one of the examples in combination with features or components from another one of the examples. In addition, the various FIGS. accompanying this disclosure are not necessarily to scale, and some features may be exaggerated or minimized to show certain details of a particular component or arrangement.

One of ordinary skill in this art would understand that the above-described embodiments are exemplary and non-limiting. That is, modifications of this disclosure would come within the scope of the claims. Accordingly, the following claims should be studied to determine their true scope and content.

The invention claimed is:

1. A passenger conveyer system, comprising:

a suspension member;

a sheave configured to rotate on a bearing, wherein the suspension member is wrapped around at least a portion of the sheave;

a sensor mounted to a termination attached to an end of the suspension member; and a controller configured to determine a condition of the bearing based on an output of the sensor.

2. The passenger conveyer system as recited in claim 1, further comprising:

an elevator car; and a counterweight;

wherein the sheave is mounted adjacent one of the elevator car and the counterweight.

3. The passenger conveyer system as recited in claim 2, wherein:

the sheave is a first sheave configured to rotate on a first bearing and mounted adjacent the elevator car, the passenger conveyer system includes a second sheave configured to rotate on a second bearing, the second sheave is mounted adjacent the counterweight, and the suspension member is wrapped around at least a portion of the first and second sheaves.

4. The passenger conveyer system as recited in claim 3, wherein:

the sensor is a first sensor mounted adjacent a first end of the suspension member, and the passenger conveyer system includes a second sensor mounted adjacent a second end of the suspension member opposite the first end.

5. The passenger conveyer system as recited in claim 4, wherein:

the first end of the suspension member is an end of a segment of the suspension member extending directly to the first sheave, and the second end of the suspension member is an end of a segment of the suspension member extending directly to the second sheave.

6. The passenger conveyer system as recited in claim 5, wherein:

the controller is configured to determine a condition of the first bearing based on an output of the first sensor, and the controller is configured to determine a condition of the second bearing based on an output of the second sensor.

7. The passenger conveyer system as recited in claim 1, wherein the sensor is an accelerometer.

8. The passenger conveyer system as recited in claim 1, wherein the controller is configured to identify a potential impaired condition of the bearing when the output of the sensor exceeds a threshold.

9. The passenger conveyer system as recited in claim 8, wherein the controller applies a filter to the output of the sensor to reject portions of the output unlikely to be indicative of the potential impaired condition.

10. The passenger conveyer system as recited in claim 8, wherein:

the threshold is a threshold in at least one of a time domain and a frequency domain, and the controller is configured to identify the potential impaired condition based on an amplitude of an output of the sensor exceeding the threshold in a time domain or a frequency domain.

11. The passenger conveyer system as recited in claim 10, wherein the controller determines an RMS acceleration based on the output and compares the RMS acceleration to the threshold.

12. The passenger conveyer system as recited in claim 8, wherein the controller is configured to identify a plurality of different potential impaired conditions of the bearing when the output of the sensor exceeds a threshold corresponding to a respective one of the plurality of different potential impaired conditions.

13. The passenger conveyer system as recited in claim 12, wherein the plurality of different potential impaired conditions include potential impairments of a ball of the bearing, a cage of the bearing, an outer race of the bearing, and an inner race of the bearing.

14. The passenger conveyer system as recited in claim 1, further comprising a drive shaft, wherein the sensor is not mounted to the drive shaft or adjacent to a segment of the suspension member leading directly to the drive shaft, wherein the drive shaft is connected to a motor.

15. The passenger conveyer system as recited in claim 1, wherein the controller is configured to cause a prompt to be issued in response the controller identifying a potential impaired condition of the bearing.

16. The passenger conveyer system as recited in claim 1, wherein the termination includes one or more of wedge sockets, swaged terminals, ferrules and thimbles.

17. A method, comprising:

identifying a potential impaired condition of a bearing of a sheave based on an output of a sensor mounted to a termination attached to an end of a suspension member, wherein the sheave is mounted adjacent one of an elevator car and a counterweight.

18. The method as recited in claim 17, wherein the identifying step includes identifying at least one of an impairment of a ball of the bearing, a cage of the bearing, an outer race of the bearing, and an inner race of the bearing.

19. The method as recited in claim 17, wherein the identifying step includes determining that the output of the sensor exceeded a threshold in at least one of a time domain and a frequency domain.

20. A method, comprising:

identifying a potential impaired condition of a first bearing of a first sheave mounted adjacent an elevator car based on an output of a first sensor mounted adjacent a first end of a suspension member, wherein a segment of the suspension member leads directly from the first end to the first sheave; and identifying a potential impaired condition of a second bearing of a second sheave mounted adjacent a counterweight based on an output of a second sensor mounted adjacent a second end of the suspension member, wherein a segment of the suspension member leads directly from the second end to the second sheave.

* * * * *